US005240804A

United States Patent [19]

Nakano et al.

[11] Patent Number: 5,240,804

[45] Date of Patent: Aug. 31, 1993

[54] ELECTROPHOTOGRAPHIC DEVELOPER COMPRISING RESIN COATED CARRIER

[75] Inventors: Tetsuya Nakano, Nabari; Naruo Yabe, Kobe; Masahide Inoue, Kitakatsuragi; Teruaki Teratani, Mino; Koichi Tsuyama, Kobe; Seijiro Ishimaru, Ibaraki; Yoshitake Shimizu, Higashiosaka, all of Japan

[73] Assignee: Mita Industrial Co., Ltd., Osaka, Japan

[21] Appl. No.: 736,436

[22] Filed: Jul. 26, 1991

[30] Foreign Application Priority Data

Jul. 26, 1990 [JP] Japan ..... 2-200297
Jul. 26, 1990 [JP] Japan ..... 2-200298

[51] Int. Cl.[5] ..... G03G 9/113

[52] U.S. Cl. ..... 430/108; 430/106; 430/109; 430/111; 430/110

[58] Field of Search ..... 430/111, 108, 122, 109, 430/106

[56] References Cited

U.S. PATENT DOCUMENTS 4,042,517 8/1977 Moriconi et al. ..... 252/62.1 P
4,572,885 2/1986 Sato et al. ..... 430/99
4,912,005 3/1990 Goodman et al. ..... 430/108
4,965,160 10/1990 Nagatsuka et al. ..... 430/108

FOREIGN PATENT DOCUMENTS 332212 10/1989 European Pat. Off. .
59-88749 5/1984 Japan .

OTHER PUBLICATIONS

Patent Abstracts of Japan vol. 8, No. 204 (P-301) Sep. 18, 1984, No. 59-088742 Abstract only.
Patent Abstracts of Japan vol. 9, No. 190 (P-378) (1913) Aug. 7, 1985, No. 60-59369 Abstract.

*Primary Examiner*—Marion E. McCamish
*Assistant Examiner*—Rosemary Ashton
*Attorney, Agent, or Firm*—Beveridge, DeGrandi, Weilacher & Young

[57] ABSTRACT

The present invention provides an electrophotographic developer comprising (i) a toner containing a fixing resin in which the content of an acrylic component is limited to a predetermined range, or a toner of which surface dye density is limited to a predetermined range, and (ii) a carrier coated with a coating resin containing, as an acrylic component, dodecyl methacrylate or 2-hydroxyethyl acrylate.

In the electrophotographic developer of the present invention, the electric charging characteristics are always stable.

10 Claims, No Drawings

ELECTROPHOTOGRAPHIC DEVELOPER COMPRISING RESIN COATED CARRIER

BACKGROUND OF THE INVENTION

The present invention relates to an electrophotographic developer and more particularly to a two-component electrophotographic developer containing a toner and a carrier, to be used for an image forming apparatus such as an electrostatic copying apparatus, a laser beam printer or the like.

In the image forming apparatus above-mentioned, the surface of a photoreceptor is exposed to light to form an electrostatic latent image on the surface of the photoreceptor. By a developing device, an electrophotographic developer is let come in contact with the surface of the photoreceptor. The toner contained in the electrophotographic developer is electrostatically sticked to the electrostatic latent image, so that the electrostatic latent image is formed into a toner image. From the photoreceptor surface, the toner image is transferred to and fixed on paper. Thus, an image corresponding to the electrostatic latent image is formed on the paper surface.

As the electrophotographic developer, there is generally used a two-component developer containing a toner and a carrier which is adapted to circulate in the developing device while adsorbing the toner.

As the toner, there may be used one as obtained by blending a fixing resin with a coloring agent such as carbon black, a charge controlling agent and the like and by pulverizing the blended body into particles having sizes in a predetermined range.

As the carrier, there may be preferably used a carrier having a core material made of iron particles or the like, of which surface is coated with a coating resin. The object of such coating of the carrier core material at the surface thereof with a coating resin is to control the toner electric charge amount and polarity, to improve the dependency of the developer electric charge on humidity and to prevent the occurrence of filming.

As the fixing resin and the coating resin, a styrene-acrylic copolymer may be suitably used in view of ease of handling and the like.

However, a conventional electrophotographic developer presents the following problems. That is, the electric charging characteristics are unstable at the initial stage just after a toner and a carrier are agitated and mixed with each other to cause the toner and carrier to be electrically charged at the time of the production of a start developer, the resupply of a toner or the like. Further, when a developing operation is repeated, the electric charging characteristics are deteriorated and become unstable with the passage of time. When the electric charging characteristics become unstable, the image density may vary and the image may present fog due to toner scattering. Further, if a great amount of toner scatters, the toner consumption is increased and the toner density of the developer varies, failing to maintain the proper toner density.

The following is considered to be two main reasons of why the electric charging characteristics of an electrophotographic developer become unstable.

(1) Variations in electric charging characteristics due to the composition of a styrene-acrylic copolymer used as a toner fixing resin or a carrier coating resin (2) Variations in electric charging characteristics due to an electric charge controlling dye contained in a toner fixing resin for adjusting the electric charging characteristics First, the following will discuss the variations in electric charging characteristics due to the composition of a styrene-acrylic copolymer.

The inventors of the present invention have studied, from various points of view, the relationship between the electric charging characteristics of an electrophotographic developer and the composition of a styrene-acrylic copolymer, i.e., the types and blending ratio of a styrene component and an acrylic component contained in the styrene-acrylic copolymer. The inventors have found that the electric charging characteristics of the electrophotographic developer depend on the type and amount of a functional group (such as a —COO— group or the like) of the acrylic component in the styrene-acrylic copolymer.

It has been known that the functions of the developer such as mechanical properties, paper-adhesive properties of the toner, off-set and the like depend on the blending ratio of the styrene component and the acrylic component in a styrene-acrylic copolymer. In this connection, the blending ratio of the styrene component and the acrylic component in each of the toner fixing resin and the carrier coating resin has been determined in view of the mechanical properties and the like above-mentioned.

It has not been known, however, the electric charging characteristics of an electrophotographic developer have depended on the type and amount of a functional group of the acrylic component in a styrene-acrylic copolymer. Accordingly, no consideration has been made at all on such data and there has been used a styrene-acrylic copolymer in which the type and amount of a functional group of the acrylic component have not been properly determined, so that the developer has showed variations in electric charging characteristics.

To eliminate variations in electric charging characteristics due to the composition of a styrene-acrylic copolymer to stabilize the electric charging characteristics without injury to the mechanical properties and the like, the inventors have tried to determine a range of the content of an acrylic component in a toner fixing resin, a range of the content of an acrylic component in a carrier coating resin and a range of the ratio of both contents above-mentioned. However, the inventors could not stabilize the electric charging characteristics perfectly only with the determination of the ranges above-mentioned.

Now, the following description will discuss the variations in electric charging characteristics due to an electric charge controlling dye for adjusting the electric charging characteristics.

In a conventional electrophotographic developer, an electric charge controlling dye has been contained in a toner fixing resin in order to prevent the electric charging characteristics from varying as above-mentioned.

However, the conventional developer has presented a problem that, even though the content of the electric charge controlling dye has been constant, the toner has shown variations in electric charging characteristics, causing the developer to become unstable in electric charging characteristics.

According to the study of the inventors, it has been found that the electric charging characteristics of a toner have been determined by a surface dye density, i.e., the amount of an electric charge controlling dye which has been exposed to the surfaces of the toner particles to contribute to the transfer of electric charge. Conventionally, the dispersion of the electric charge controlling dye in the toner particles has not been uniform so that, even though the content of the electric charge controlling dye has been the same, the surface dye density has not been constant, causing the electric charging characteristics of the toner to vary.

In view of the foregoing, the inventors have tried to stabilize the electric charging characteristics of an electrophotographic developer by determining a preferable range of the surface dye density of the toner particles to eliminate variations in electric charging characteristics of the toner. However, only with the determination of the range of the surface dye density, the electric charging characteristics could not been perfectly stabilized.

SUMMARY OF THE INVENTION

It is a main object of the present invention to provide an electrophotographic developer of which electric charging characteristics are always stable.

To achieve the object above-mentioned, the inventors of the present invention have further studied the reason of why an electrophotographic developer still shows variations in electric charging characteristics even though there have been determined a preferable range of the composition of a styrene-acrylic copolymer and a preferable range of the surface dye density of toner particles. Then, the inventors have found that variations in electric charging characteristics have been mainly caused by a carrier coating resin.

More specifically, a resistance adjusting agent such as carbon black or the like is generally dispersed in the carrier coating resin for adjusting the electric charging characteristics. However, a conventional styrene-acrylic copolymer is poor in compatibility with the resistance adjusting agent to prevent the resistance adjusting agent from being uniformly dispersed therein. In this connection, the coating resin shows variations in electric charging characteristics at the initial stage, so that the electric charging characteristics are unstable at the initial stage just after a toner and a carrier are agitated and mixed with each other to cause the toner and carrier to be electrically charged at the time of the production of a start developer, the resupply of a toner or the like.

To enhance the electric charging characteristics, the content of the acrylic component in a coating resin composed of a styrene-acrylic copolymer is generally set to not less than 70% by weight. In such a styrene-acrylic copolymer containing an acrylic component in a high content, the adhesive properties with respect to the carrier core material is insufficient and the strength of the coating film is also insufficient. Accordingly, when a developing operation is repeated so that the developer is subjected to a mechanical pressure, an impact force, friction and the like in a developing device, the coating resin falls or partially comes off from the carrier core material. This results in injury to the carrier surface smoothness to change the carrier surface condition, so that the electric charging characteristics become unstable with the passage of time.

The inventors have further studied the material of the coating resin and now completed the present invention.

According to a first embodiment of the present invention, there is provided an electrophotographic developer which comprises (i) a toner containing, as a fixing resin, a styrene-acrylic copolymer including an acrylic component in a range from 10 to 30% by weight and (ii) a carrier coated with a coating resin composed of a styrene-acrylic copolymer containing at least dodecyl methacrylate and including an acrylic component in a range from 70 to 90% by weight, and in which the ratio $C_A/T_A$ of the content $T_A$ % by weight of the acrylic component in the fixing resin to the content $C_A$ % by weight of the acrylic component in the coating resin is in a range from greater than 3 to smaller than 6.

According to the first embodiment of the present invention having the arrangement above-mentioned, the dodecyl methacrylate contained in the carrier coating resin improves the compatibility of the coating resin with a resistance adjusting agent such as carbon black or the like. It is therefore possible to disperse the resistance adjusting agent uniformly in the coating resin to stabilize the electric charging characteristics of the carrier.

According to a second embodiment of the present invention, there is provided an electrophotographic developer which comprises the toner above-mentioned and a carrier coated with a coating resin composed of a styrene-acrylic copolymer containing at least 2-hydroxyethyl acrylate and including an acrylic component in a range from 70 to 90% by weight, and in which the ratio $C_A/T_A$ of the content $T_A$ % by weight of the acrylic component in the fixing resin to the content $C_A$ % by weight of the acrylic component in the coating resin is in the range above-mentioned.

According to the second embodiment of the present invention having the arrangement above-mentioned, the 2-hydroxyethyl acrylate contained in the carrier coating resin improves not only the strength of the coating film but also the adhesive properties of the coating resin with respect to the carrier core material. It is therefore possible to prevent the coating resin from coming off or partially falling down to stabilize the electric charging characteristics of the carrier.

According to a third embodiment of the present invention, there is provided an electrophotographic developer comprising (i) a toner in which the fixing resin contains a coloring agent and an electric charge controlling dye and of which surface dye density is in a range from 0.004 to 0.006 g/g and (ii) a carrier coated with a coating resin in which a resistance adjusting agent is contained in a styrene-acrylic copolymer containing at least dodecyl methacrylate.

According to the third embodiment of the present invention having the arrangement above-mentioned, the dodecyl methacrylate contained in the carrier coating resin improves the compatibility of the coating resin with a resistance adjusting agent such as carbon black or the like. It is therefore possible to disperse the resistance adjusting agent uniformly in the coating resin to stabilize the electric charging characteristics of the carrier.

DETAILED DESCRIPTION OF THE INVENTION

According to any of the first and third embodiments of the present invention, there is used a carrier of which core material made of any of various conventional materials is coated at the surface thereof with a coating resin composed of a styrene-acrylic copolymer containing dodecyl methacrylate. The content of the dodecyl methacrylate in the acrylic component of the styrene-acrylic copolymer is preferably not greater than 5% by weight and more preferably in a range from 0.1 to 2% by weight. If the content of dodecyl methacrylate in the acrylic component is less than 0.1% by weight, the coating resin is lowered in compatibility with the resistance adjusting agent such as carbon black or the like. Accordingly, there is a possibility of the resistance adjusting agent not being uniformly dispersed. On the other hand, if the content of dodecyl methacrylate exceeds 5% by weight, the humidity resistance is lowered. This may not only deteriorate the electric charging characteristics at the initial stage but also cause the amount of electric charge to be remarkably lowered due to change with the passage of time.

According to the second embodiment of the present invention, there is used a carrier of which core material is coated at the surface thereof with a coating resin composed of a styrene-acrylic copolymer containing 2-hydroxyethyl acrylate. The content of the 2-hydroxyethyl acrylate in the acrylic component of the styrene-acrylic copolymer is preferably not greater than 5% by weight, and more preferably in a range from 0.1 to 2% by weight. If the content of 2-hydroxyethyl acrylate in the acrylic component is less than 0.1% by weight, there is the likelihood that the adhesive properties of the coating resin with respect to the carrier core material and the strength of the coating film are not sufficient. On the other hand, if the content of 2-hydroxyethyl acrylate exceeds 5% by weight, adverse effects may be exerted to the humidity resistance and the electric charging characteristics.

The coating resin containing dodecyl methacrylate may contain 2-hydroxyethyl acrylate, and the coating resin containing 2-hydroxyethyl acrylate may contain dodecyl methacrylate.

According to any of the first and second embodiments of the present invention, the content of the entire acrylic component in the styrene-acrylic copolymer serving as the coating resin is limited to a range from 70 to 90% by weight.

If the content of the acrylic component is less than 70% by weight, the electric charging characteristics (charge imparting properties) are lowered particularly at the initial stage just after a toner and a carrier are agitated and mixed with each other to cause the toner and carrier to be electrically charged. If the content of the acrylic component exceeds 90% by weight, the adhesive properties of the coating resin with respect to the carrier core material and the strength of the coating film are lowered.

According to the third embodiment of the present invention, the content of the acrylic component in the styrene-acrylic copolymer serving as the coating resin is not particularly limited to a certain value, but is preferably in a range from 70 to 90% by weight for the same reasons above-mentioned.

As the styrene component which forms a styrene-acrylic copolymer together with dodecyl methacrylate and/or 2-hydroxyethyl acrylate, there may be used a styrene monomer such as vinyltoluene, α-methylstyrene or the like, besides styrene. As other acrylic component than dodecyl methacrylate and 2-hydroxyethyl acrylate, there may be used an acrylic monomer represented by the following general formula (I):

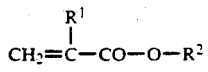

$$CH_2=\overset{\overset{R^1}{|}}{C}-CO-O-R^2 \quad (I)$$

wherein $R^1$ is a hydrogen atom or a lower alkyl group, $R^2$ is a hydrogen atom, a hydrocarbon group having 1 to 12 carbon atoms, a hydroxyalkyl group, a vinylester group or an aminoalkyl group.

Examples of the acrylic monomer represented by the general formula (I), include acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, hexyl methacrylate, 2-ethylhexyl methacrylate, ethyl β-hydroxyacrylate, propyl γ-hydroxyacrylate, butyl δ-hydroxyacrylate, ethyl β-hydroxymethacrylate, propyl γ-aminoacrylate, propyl γ-N,N-diethylaminoacrylate, ethylene glycol dimethacrylate, tetraethylene glycol dimethacrylate and the like.

A styrene/ethyl methacrylate copolymer may be used as the most suitable styrene-acrylic copolymer serving as the coating resin. There may be preferably used a styrene/ethyl methacrylate copolymer containing 10 to 30% by weight of styrene, 70 to 90 by weight of ethyl methacrylate and 0.1 to 5% by weight of dodecyl methacrylate or 2-hydroxyethyl acrylate. Among other acrylic monomer than dodecyl methacrylate and 2-hydroxyethyl acrylate, the ethyl methacrylate above-mentioned is excellent in the stability of the electric charging characteristics at the initial stage and securely prevents the electric charging characteristics from being deteriorated with the passage of time.

The copolymer may be produced by any of conventional polymerization methods such as a solution polymerization or the like.

Examples of the resistance adjusting agent contained in the coating resin include carbon black such as furnace black, channel black, thermal, gas black, oil black, acetylene black and the like, and a variety of conventional resistance adjusting agents. The content of the resistance adjusting agent is not particularly limited to a certain value, but is preferably in a range from 0.5 to 5% by weight. If the content of the resistance adjusting agent is less than 0.5% by weight, it may not be possible to produce satisfactorily the effect as would be obtained by addition of the resistance adjusting agent. If the content of the resistance adjusting agent exceeds 5% by weight, the content of dodecyl methacrylate should be increased to maintain the compatibility with the coating resin, thus decreasing the humidity resistance. This may not only deteriorate the electric charging characteristics at the initial stage, but also cause the amount of electric charge to be considerably lowered due to change with the passage of time.

The coating resin may also contain, in addition to the resistance adjusting agent, about 0.5 to about 3% by weight of a metallic complex as an electric charge controlling agent.

Examples of the carrier core material include (i) particles of iron, oxidized iron, reduced iron, magnetite, copper, silicon steel, ferrite, nickel, cobalt and the like, (ii) particles of alloys of any of the metals above-mentioned with manganese, zinc, aluminium and the like, (iii) particles of an iron-nickel alloy, an iron-cobalt alloy and the like, (iv) particles obtainable by dispersing any of the particles above-mentioned in a binder resin, (v) particles of ceramics such as titanium oxide, aluminium oxide, copper oxide, magnesium oxide, lead oxide, zirconium oxide, silicon carbide, magnesium titanate, barium titanate, lithium titanate, lead titanate, lead zirconate, lithium niobate and the like, and (vi) particles of high-permittivity substances such as ammonium dihydrogen phosphate ($NH_4H_2PO_4$), potassium dihydrogen phosphate ($KH_2PO_4$), Rochelle salt and the like. Of these, iron powder of iron oxide, reduced iron and the like, and ferrite are preferable in view of low cost and excellent image characteristics.

Any of conventional coating methods such as a fluidized bed method, a rolling bed method and the like may be used for coating the carrier core material at the surface thereof with the coating resin comprising the styrene-acrylic copolymer above-mentioned.

The particle sizes of the carrier core material are preferably from 30 to 200 μm and more preferably from 50 to 130 μm. The coating film thickness is preferably from 0.1 to 5 μm and more preferably from 0.5 to 3 μm.

The toner which forms an electrophotographic developer together with the carrier above-mentioned may be produced by blending the fixing resin with additives such as a coloring agent, a charge controlling agent, a release agent (off-set preventing agent) and the like, and by pulverizing the blended body into particles having suitable particle sizes.

According to any of the first and second embodiments of the present invention, the fixing resin is limited to a styrene-acrylic copolymer.

Examples of the styrene-acrylic copolymer include a variety of copolymers composed of any of the styrene monomers above-mentioned and any of the acrylic monomers above-mentioned.

The content of the acrylic component in the styrene-acrylic copolymer serving as the fixing resin is limited to the range from 10 to 30% by weight.

If the content of the acrylic component is less than 10% by weight, the electric charging characteristics and paper-fixing properties are deteriorated. If the content of the acrylic component exceeds 30% by weight, the environmental resistance is lowered so that the electric charging characteristics are liable to undergo a change in response to variations of humidity, temperature and the like. Further, there is apt to be produced a so-called reversely polarized toner by which the developer is electrically charged in the polarity opposite to the polarity in which the developer should be electrically charged.

A styrene/methyl methacrylate/butyl acrylate copolymer may be used as the styrene-acrylic copolymer which is the most suitable for the fixing resin. There may be preferably used a styrene/methyl methacrylate/butyl acrylate copolymer containing 75 to 85% by weight of styrene, 0.5 to 5% by weight of methyl methacrylate and 10 to 20% by weight of butyl acrylate.

According to the third embodiment of the present invention, the fixing resin is not limited to the styrene-acrylic copolymer, but any of a variety of conventional resin materials may be used as the fixing resin.

Examples of the fixing resin include styrene resins (monopolymers and copolymers containing styrene or a styrene substituent) such as polystyrene, chloropolystyrene, poly-α-methylstyrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-acrylate copolymer (a styrene-methyl acrylate copolymer, a styrene-ethyl acrylate copolymer, a styrene-butyl acrylate copolymer, a styrene-octyl acrylate copolymer, a styrene-phenyl acrylate copolymer or the like), a styrene-methacrylate copolymer (a styrene-methyl methacrylate copolymer, a styrene-ethyl methacrylate copolymer, a styrene-butyl methacrylate copolymer, a styrene-phenyl methacrylate copolymer or the like), a styrene-α-methyl chloroacrylate copolymer, a styrene-acrylonitrile-acrylate copolymer and the like. Examples of the fixing resin further include polyvinyl chloride, low-molecular-weight polyethylene, low-molecular-weight polypropylene, an ethylene-ethyl acrylate copolymer, polyvinyl butyral, an ethylene-vinyl acetate copolymer, rosin modified maleic acid resin, phenolic resin, epoxy resin, polyester resin, ionomer resin, polyurethane resin, silicone resin, ketone resin, xylene resin, polyamide resin and the like. The examples above-mentioned of the fixing resin may be used alone or in combination of plural types. Of these, the styrene resin is preferred, and the styrene-(meth)acrylate copolymer is more preferred. More preferably, there may be used a styrene/-methyl methacrylate/butyl acrylate copolymer containing 75 to 85% by weight of styrene, 0.5 to 5% by weight of methyl methacrylate and 10 to 20% by weight of butyl acrylate, as mentioned earlier.

Examples of the coloring agent include a variety of a coloring pigment, an extender pigment, a conductive pigment, a magnetic pigment, a photoconductive pigment and the like. The coloring agent may be used alone or in combination of plural types according to the application.

The following examples of the coloring pigment may be suitably used.

Black

Carbon black such as furnace black, channel black, thermal, gas black, oil black, acetylene black and the like, Lamp black, Aniline black White Zinc white, Titanium oxide, Antimony white, Zinc sulfide Red Red iron oxide, Cadmium red, Red lead, Mercury cadmium sulfide, Permanent red 4R, Lithol red, Pyrazolone red, Watching red calcium salt, Lake red D, Brilliant carmine 6B, Eosine lake, Rhodamine lake B, Alizarine lake, Brilliant carmine 3B Orange Chrome orange, Molybdenum orange, Permanent orange GTR, Pyrazolone orange, Vulcan orange, Indanthrene brilliant orange RK, Benzidine orange G, Indanthrene brilliant orange GK Yellow Chrome yellow, Zinc yellow, Cadmium yellow, Yellow iron oxide, Mineral fast yellow, Nickel titanium yellow, Naples yellow, Naphthol yellow S, Hansa yellow G, Hansa yellow 10G, Benzidine yellow G, Benzidine yellow GR, Quinoline yellow lake, Permanent yellow NCG, Tartrazine lake Green Chrome green, Chromium oxide, Pigment green B, Malachite green lake, Fanal yellow green G Blue Prussian blue, Cobalt blue, Alkali blue lake, Victoria blue lake, Partially chlorinated phthalocyanine blue, Fast sky blue, Indanthrene blue BC Violet Manganese violet, Fast violet B, Methyl violet lake Examples of the extender pigment include Baryte powder, barium carbonate, clay, silica, white carbon, talc, alumina white.

Examples of the conductive pigment include conductive carbon black, aluminium powder and the like.

Examples of the magnetic pigment include a variety of ferrites such as triiron tetroxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_4$), copper iron oxide ($CuFe_2O_4$), lead iron oxide ($PbFe_{12}O_{19}$), neodymium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder, cobalt powder, nickel powder and the like.

Examples of the photoconductive pigment include zinc oxide, selenium, cadmium sulfide, cadmium selenide and the like.

According to any of the first and second embodiments of the present invention, the coloring agent may be contained in an amount from 1 to 30 parts by weight and preferably from 2 to 20 parts by weight for 100 parts by weight of the fixing resin. According to the third embodiment of the present invention, the coloring agent may be contained in an amount from 1 to 20 parts by weight and preferably from 3 to 15 parts by weight for 100 parts by weight of the fixing resin.

Examples of the release agent (off-set preventing agent) include aliphatic hydrocarbon, aliphatic metal salts, higher fatty acids, fatty esters, its partially saponified substances, silicone oil, waxes and the like. Of these, there is preferably used aliphatic hydrocarbon of which weight-average molecular weight is from 1,000 to 10,000. More specifically, there is suitably used one or a combination of plural types of low-molecular-weight polypropylene, low-molecular-weight polyethylene, paraffin wax, a low-molecular-weight olefin polymer composed of an olefin monomer having 4 or more carbon atoms and the like.

The release agent may be used in an amount from 0.1 to 10 parts by weight and preferably from 0.5 to 8 parts by weight for 100 parts by weight of the fixing resin.

As the electric charge controlling dye, there may be used either one of two different electric charge controlling dyes of the positive charge controlling type and the negative charge controlling type, according to the toner polarity.

Examples of the electric charge controlling dye of the positive charge controlling type include a basic dye, aminopyrine, a pyrimidine compound, a polynuclear polyamino compound, aminosilane and the like, and a filler of which surface is treated with any of the substances above-mentioned. Preferably, there may be used Black 1, 2, 3, 5, 7 according to the color index classification C. I. Solvet (oil soluble dyes).

As the electric charge controlling dye of the negative charge controlling type, there may be used a compound containing a carboxy group (such as metallic chelate alkyl salicylate or the like), a metal complex salt dye, fatty acid soap, metal salt naphthenate or the like. Preferably, there may be used an alcohol-soluble complex salt azo dye containing chromium, iron or cobalt. More preferably, there may be used a sulfonyl amine derivative of copper phthalocyanine or a metal-containing monoazo dye of the 2:1 type represented by the following formula (II):

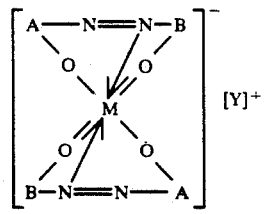

(II)

(wherein A is a residual group of a diazo component having a phenolic hydroxyl group at the ortho-position; B is a residual group of a coupling component; M is a chromium, iron, aluminium, zinc or cobalt atom; and $[Y]^+$ is an inorganic or organic cation).

The electric charge controlling dye may be used in an amount from 0.1 to 10 parts by weight and more preferably from 0.5 to 8 parts by weight for 100 parts by weight of the fixing resin.

According to the third embodiment of the present invention, the toner surface dye density is limited to a range from 0.004 to 0.006 g/g.

If the toner surface dye density is less than 0.004 g/g, the image density is insufficient. On the other hand, if the surface dye density exceeds 0.006 g/g, the image presents fog.

The surface dye density refers to a value obtained in the following manner. That is, only the dye on the surfaces of toner particles is selectively extracted by a solvent such as methyl alcohol or the like which dissolves only the electric charge controlling dye, and the solution thus extracted is measured by an absorbance measuring method or the like to obtain the amount of the extracted dye, which is then converted into the amount of dye per toner of 1 gram.

To produce the toner of which surface dye density is in the range above-mentioned, the components above-mentioned are preliminary mixed sufficiently with the use of a mixing machine such as a Henschel mixer, a super mixer, a ball mill or the like in which shear force acts, and the resultant dry mixture is uniformly molten and kneaded with the use of a double-shaft extruder, a three-roller unit, a kneader or the like. Then, the resultant kneaded body is cooled, ground and classified as necessary.

According to the first or second embodiment of the present invention in which the toner surface dye density is not limited to a certain range, the toner may also be produced by any of other methods such as a suspension polymerization or the like, besides the production method including melting, kneading and classification above-mentioned.

The toner particle sizes may be in a range preferably from 3 to 35 $\mu$m and more preferably from 5 to 25 $\mu$m, as conventionally done. According to the third embodiment of the present invention, however, the percentage by the number of toner particles of which sizes as measured with a coalter counter are greater than 16 $\mu$m, is preferably in a range satisfying the following formula (III):

$$N < -172.7^\circ C. + 1.45 \quad \text{(III)}$$

wherein N is the percentage by the number of the toner particles of which sizes as measured with a coalter counter are greater than 16 $\mu$m, and C is the surface dye density of toner particles (g/g).

When the distribution of toner particle sizes is in the range above-mentioned, it is possible, in view of the relationship with the surface dye density, to further eliminate variations in electric charging characteristics of the toner.

To adjust the toner particle-size distribution to the range satisfying the formula (III) above-mentioned, the ground toner particles may be classified to remove particles having sizes greater than 16 μm, or toner particles may be ground such that the peak of the toner particle-size distribution is shifted to a smaller-size zone to reduce the content of particles having sizes greater than 16 μm.

To improve the flowability, the toner surface may be covered with a conventional surface treating agent such as inorganic fine particles (such as hydrophobic silica fine particles), fluoroplastic particles or the like.

According to the first or second embodiment of the present invention, the ratio $C_A/T_A$ of the content $T_A$ % by weight of the acrylic component in the toner fixing resin to the content $C_A$ % by weight of the acrylic component in the coating resin is limited to the range from greater than 3 to smaller than 6.

If the ratio $C_A/T_A$ is not greater than 3, the content of the acrylic component in the carrier coating resin is relatively reduced. This decreases the carrier in the amount of electric charge to produce image fog due to toner scattering. On the other hand, if the $C_A/T_A$ is not less than 6, the content of the acrylic component in the carrier coating resin is relatively increased. This causes the toner to be excessively increased in the amount of electric charge, thereby to lower the image density.

The blending ratio of the toner and the carrier may be suitably changed according to an image forming apparatus to be used.

According to the first embodiment of the present invention, the content of the acrylic component in each of the toner fixing resin and the carrier coating resin is limited to a predetermined range, and the dodecyl methacrylate contained in the carrier coating resin enhances the compatibility of the coating resin with the resistance adjusting agent such as carbon black or the like to assure a uniform dispersion of the resistance adjusting agent, thereby to make uniform the initial electric charging characteristics, so that there may be obtained an electrophotographic developer of which electric charging characteristics are always stabilized.

According to the second embodiment of the present invention, the content of the acrylic component in each of the toner fixing resin and the carrier coating resin is limited to a predetermined range, and the 2-hydroxyethyl acrylate contained in the carrier coating resin enhances not only the strength of the coating film but also the adhesive properties of the coating resin with respect to the carrier core material, so that there may be obtained an electrophotographic developer of which electric charging characteristics are always stabilized.

According to the third embodiment of the present invention, the surface dye density of the toner is limited to a predetermined range, and the dodecyl methacrylate contained in the carrier coating resin enhances the compatibility of the coating resin with the resistance adjusting agent such as carbon black or the like to assure a uniform dispersion of the resistance adjusting agent, thereby to make uniform the initial electric charging characteristics, so that there may be obtained an electrophotographic developer of which electric charging characteristics are always stabilized.

EXAMPLES

The following description will further discuss the present invention with reference to Examples thereof and Comparative Examples.

EXAMPLES 1 TO 10 AND COMPARATIVE EXAMPLES 1 TO 10

The following toners and carriers were combined with each other in the manners shown in Tables 1A to Table 1C at a ratio by weight of 3.5:96.5, and agitated and mixed with a Nauter mixer (NX-S manufactured by Hosokawa Micron Co., Ltd.) to produce developers of Examples 1 to 10 and Comparative Examples 1 to 10.

Toner (a)

There were mixed (i) 100 parts by weight of a styrene (St)/methyl methacrylate (MMA)/butyl acrylate (BA) copolymer [St:MMA:BA=80:5:15 (ratio by weight), Acrylic-component content $T_A$=20% by weight], (ii) 8 parts by weight of carbon black as the coloring agent, (iii) 1 part by weight of a negative-polarity dye as the electric charge controlling dye, and (iv) 1 part by weight of low-molecular-weight polypropylene as the off-set preventing agent. After molten and kneaded, the resulting mixture was cooled, ground and classified to produce a toner (a) having the average particle size of 12 μm.

Toner (b)

There was produced a toner (b) in the same manner as in the toner (a), except for the use of 100 parts by weight of a styrene (St)/methyl methacrylate (MMA)/butyl acrylate (BA) copolymer [St:MMA:BA=88:7:5 (ratio by weight), Acrylic-component content $T_A$=12% by weight], instead of 100 parts by weight of the copolymer used in the toner (a).

Toner (c)

There was produced a toner (c) in the same manner as in the toner (a), except for the use of 100 parts by weight of a styrene (St)/butyl acrylate (BA) copolymer [St:BA=72:28 (ratio by weight), Acrylic-component content $T_A$=28% by weight], instead of 100 parts by weight of the copolymer used in the toner (a).

Toner (d)

There was produced a toner (d) in the same manner as in the toner (a), except for the use of 100 parts by weight of a styrene (St)/methyl methacrylate (MMA)/-butyl acrylate (BA) copolymer [St:MMA:BA=92:3:5 (ratio by weight), Acrylic-component content $T_A$=8% by weight], instead of 100 parts by weight of the copolymer used in the toner (a).

Carrier (1)

By a fluidized bed method, ferrite as the carrier core material was coated at the surface thereof with a solution containing (i) 100 parts by weight of a styrene (St)/ethyl methacrylate (EMA)/dodecyl methacrylate (DMA) copolymer [St:EMA:DMA=18:80:2 (ratio by weight), Acrylic-component content $C_A$=82% by weight] as the coating resin and (ii) 2 parts by weight of carbon black as the resistance adjusting agent, thereby to prepare a carrier (1) having the average particle size of 95μm of which coating layer had a thickness of 2 μm.

Carrier (2)

There was prepared a carrier (2) in the same manner as in the carrier (1) except for the use of 100 parts by weight of a styrene (St)/ethyl methacrylate (EMA)/-dodecyl methacrylate (DMA) copolymer [St:EMA:DMA =29:70:1 (ratio by weight), Acrylic-component content $C_A$=71% by weight] instead of 100 parts by weight of the coating resin used in the carrier (1).

Carrier (3)

There was prepared a carrier (3) in the same manner as in the carrier (1) except for the use of 100 parts by weight of a styrene (St)/ethyl methacrylate (EMA)/-dodecyl methacrylate (DMA) copolymer [St:EMA:DMA =10:87:3 (ratio by weight), Acrylic-component content $C_A$=90% by weight] instead of 100 parts by weight of the coating resin used in the carrier (1).

Carrier (4)

There was prepared a carrier (4) in the same manner as in the carrier (1) except for the use of 100 parts by weight of a styrene (St)/ethyl methacrylate (EMA) copolymer [St:EMA=38:62 (ratio by weight), Acrylic-component content $C_A$=62% by weight] instead of 100 parts by weight of the coating resin used in the carrier (1).

Carrier (5)

There was prepared a carrier (5) in the same manner as in the carrier (1) except for the use of 100 parts by weight of a styrene (St)/ethyl methacrylate (EMA)/-dodecyl methacrylate (DMA) copolymer [St:EMA:DMA =8:90:2 (ratio by weight), Acrylic-component content $C_A$=92% by weight] instead of 100 parts by weight of the coating resin used in the carrier (1).

Carrier (6)

There was prepared a carrier (6) in the same manner as in the carrier (1) except for the use of 100 parts by weight of a styrene (St)/ethyl methacrylate (EMA)/-dodecyl methacrylate (DMA) copolymer [St:EMA:DMA =28:70:2 (ratio by weight), Acrylic-component content $C_A$=72% by weight] instead of 100 parts by weight of the coating resin used in the carrier (1).

Carrier (7)

There was prepared a carrier (7) in the same manner as in the carrier (1) except for the use of 100 parts by weight of a styrene (St)/ethyl methacrylate (EMA)/2-hydroxyethyl acrylate (HEA) copolymer [St:EMA:-HEA=18:80:2 (ratio by weight), Acrylic-component content $C_A$=82% by weight] instead of 100 parts by weight of the coating resin used in the carrier (1).

Carrier (8)

There was prepared a carrier (8) in the same manner as in the carrier (1) except for the use of 100 parts by weight of a styrene (St)/ethyl methacrylate (EMA)/2-hydroxyethyl acrylate (HEA) copolymer [St:EMA:-HEA=29:70:1 (ratio by weight), Acrylic-component content $C_A$=71% by weight instead of 100 parts by weight of the coating resin used in the carrier (1).

Carrier (9)

There was prepared a carrier (9) in the same manner as in the carrier (1) except for the use of 100 parts by weight of a styrene (St)/ethyl methacrylate (EMA)/2-hydroxyethyl acrylate (HEA) copolymer [St:EMA:-HEA=11:87:2 (ratio by weight), Acrylic-component content $C_A$=89% by weight] instead of 100 parts by weight of the coating resin used in the carrier (1).

Carrier (10)

There was prepared a carrier (10) in the same manner as in the carrier (1) except for the use of 100 parts by weight of a styrene (St)/ethyl methacrylate (EMA)/2-hydroxyethyl acrylate (HEA) copolymer [St:EMA:-HEA=28:70:2 (ratio by weight), Acrylic-component content $C_A$=72% by weight] instead of 100 parts by weight of the coating resin used in the carrier (1).

Carrier (11)

There was prepared a carrier (11) in the same manner as in the carrier (1) except for the use of 100 parts by weight of a styrene (St)/ethyl methacrylate (EMA)/2-hydroxyethyl acrylate (HEA) copolymer [St:EMA:-HEA=38:60:2 (ratio by weight), Acrylic-component content $C_A$=62% by weight instead] of 100 parts by weight of the coating resin used in the carrier (1).

Carrier (12)

There was prepared a carrier (12) in the same manner as in the carrier (1) except for the use of 100 parts by weight of a styrene (St)/ethyl methacrylate (EMA)/-dodecyl methacrylate (DMA)/2-hydroxyethyl acrylate (HEA) copolymer [St:EMA:DMA:HEA=20:76:2:2 (ratio by weight), Acrylic-component content $C_A$=80% by weight] instead of 100 parts by weight of the coating resin used in the carrier (1).

Carrier (13)

There was prepared a carrier (13) in the same manner as in the carrier (1) except for the use of 100 parts by weight of a styrene (St)/ethyl methacrylate (EMA)/-dodecyl methacrylate (DMA)/2-hydroxyethyl acrylate (HEA) copolymer [St:EMA:DMA:HEA=12:82:3:3 (ratio by weight), Acrylic-component content $C_A$=88% by weight] instead of 100 parts by weight of the coating resin used in the carrier (1).

TABLE 1A

| | Carrier | Toner | $C_A/T_A$ |
|---|---|---|---|
| Example 1 | (1) | (a) | 4.1 |
| Example 2 | (2) | (b) | 5.9 |
| Example 3 | (3) | (c) | 3.2 |
| Example 4 | (6) | (a) | 3.6 |
| Comparative Example 1 | (3) | (b) | 7.5 |
| Comparative Example 2 | (1) | (d) | 10.3 |
| Comparative Example 3 | (4) | (b) | 5.2 |
| Comparative Example 4 | (5) | (d) | 11.5 |
| Comparative Example 5 | (6) | (c) | 2.6 |

TABLE 1B

| | Carrier | Toner | $C_A/T_A$ |
|---|---|---|---|
| Example 5 | (7) | (a) | 4.1 |
| Example 6 | (8) | (b) | 5.9 |
| Example 7 | (9) | (c) | 3.2 |
| Example 8 | (10) | (a) | 3.6 |
| Comparative Example 6 | (9) | (b) | 7.4 |
| Comparative Example 7 | (7) | (d) | 10.3 |
| Comparative | (11) | (b) | 5.2 |

TABLE 1B-continued

| | Carrier | Toner | $C_A/T_A$ |
|---|---|---|---|
| Example 8 | | | |
| Comparative Example 9 | (10) | (c) | 2.6 |

TABLE 1C

| | Carrier | Toner | $C_A/T_A$ |
|---|---|---|---|
| Example 9 | (12) | (a) | 4.0 |
| Example 10 | (13) | (c) | 3.1 |
| Comparative Example 10 | (12) | (d) | 10.0 |

The following tests were conducted on each of the electrophotographic developers of Examples 1 to 10 and Comparative Examples 1 to 10.

Test of Image Density

With an electrophotographic copying apparatus (DC-5585 manufactured by Mita Industrial Co., Ltd.) using (i) each of the electrophotographic developers above-mentioned as a start developer and (ii) the same toner as that contained in the start developer as a resupply toner, a solid-black document was continuously copied for 50,000 pieces. By extracting the first copied piece and every thousandth copied piece, total 51 copied pieces were extracted, as samples, from 50,000 copied pieces for each of the developers. With a reflection densitometer (TC-6D manufactured by Tokyo Densyoku Co., Ltd.), the density of the copied image of each sample was measured. The developer with which there were obtained 50 or more samples presenting an image density not less than 1.3, was evaluated as excellent (O), the developer with which there were obtained 40 to 49 samples presenting an image density not less than 1.3, was evaluated as good (Δ), and the developer with which there were obtained 39 or less samples presenting an image density not less than 1.3, was evaluated as bad (X).

Test of Image Fog

With the electrophotographic copying apparatus above-mentioned using (i) each of the electrophotographic developers above-mentioned as a start developer and (ii) the same toner as that contained in the start developer as a resupply toner, a black-white document was continuously copied for 50,000 pieces. By extracting the first copied piece and every thousandth copied piece, total 51 copied pieces were extracted, as samples, from 50,000 copied pieces for each of the developers. With the reflection densitometer above-mentioned, the density of the blank spaces of each sample was measured. The developer with which there were obtained 50 or more samples presenting an image density of not greater than 0.003, was evaluated as excellent (O), the developer with which there were obtained 40 to 49 samples presenting an image density of not greater than 0.003, was evaluated as good (Δ), and the developer with which there were obtained 39 or less samples presenting an image density of not greater than 0.003, was evaluated as bad (X).

Test of Resolution

With the use of the same electrophotographic copying apparatus as that above-mentioned using (i) each of the electrophotographic developers above-mentioned as a start developer and (ii) each of the same toner as that contained in the start developer as a resupply toner, a diagram sheet for measuring resolution in accordance with JIS B 7174-1962 was continuously copied for 50,000 pieces. By extracting the first copied piece and every thousandth copied piece, total 51 copied pieces were extracted, as samples, for each developer. The resolution (lines/mm) of the copied image of each sample was obtained. The developer with which there were obtained 50 or more samples presenting resolution of 4.5 lines/mm, was evaluated as excellent (O), the developer with which there were obtained 40 to 49 samples presenting resolution of 4.5 lines/mm, was evaluated as good (Δ), and the developer with which there were obtained 39 or less samples presenting resolution of 3.5 lines/mm, was evaluated as bad (X).

Toner Scattering Test

For each of the developers, there were checked (i) the blank portion of the 50,000th copied piece taken in the fog density measurement and (ii) the inside of the copying apparatus after 50,000 copies had been taken. The developer with which substantially no toner scattering was observed on the blank portion of the copied image and the inside of the copying apparatus, was evaluated as excellent (O), and the developer with which toner scattering was observed either inside of the copying apparatus or on the blank portion of the copied image, was evaluated as bad (X).

Measurement of Electric Charge

At the time of continuous 50,000-piece copying in the fog density measurement, each of the developers above-mentioned in the developing devices was sampled at the time of the first copy and every 10,000th copy. The developers thus sampled were measured as to the electric charge ($-\mu C/g$) by a blow-off method.

The results of the test above-mentioned are shown in Table 2A to Table 2C and Table 3A to Table 3C.

TABLE 2A

| | Image Density | Image Fog | Resolution | Toner Scattering |
|---|---|---|---|---|
| Example 1 | O | O | O | O |
| Example 2 | O | O | O | O |
| Example 3 | O | O | O | O |
| Example 4 | O | O | O | O |
| Comparative Example 1 | Δ | O | O | O |
| Comparative Example 2 | X | Δ | Δ | Δ |
| Comparative Example 3 | Δ | Δ | Δ | Δ |
| Comparative Example 4 | Δ | Δ | Δ | X |
| Comparative Example 5 | Δ | Δ | Δ | X |

TABLE 2B

| | Image Density | Image Fog | Resolution | Toner Scattering |
|---|---|---|---|---|
| Example 5 | O | O | O | O |
| Example 6 | O | O | O | O |
| Example 7 | O | O | O | O |
| Example 8 | O | O | O | O |
| Comparative Example 6 | Δ | O | Δ | O |
| Comparative Example 7 | X | Δ | X | Δ |
| Comparative Example 8 | Δ | Δ | X | Δ |
| Comparative | Δ | Δ | Δ | X |

TABLE 2B-continued

| | Image Density | Image Fog | Resolution | Toner Scattering |
|---|---|---|---|---|
| Example 9 | | | | |

TABLE 2C

| | Image Density | Image Fog | Resolution | Toner Scattering |
|---|---|---|---|---|
| Example 9 | ○ | ○ | ○ | ○ |
| Example 10 | ○ | ○ | ○ | ○ |
| Comparative Example 10 | ○ | Δ | ○ | Δ |

TABLE 3A

| | Toner Electric Charge (−μC/g) | | | | | |
|---|---|---|---|---|---|---|
| | 1st piece | 10000th piece | 20000th piece | 30000th piece | 40000th piece | 50000th piece |
| Example 1 | 21.5 | 22.4 | 21.3 | 20.9 | 20.8 | 20.7 |
| Example 2 | 22.6 | 22.3 | 22.1 | 21.9 | 22.0 | 22.1 |
| Example 3 | 22.0 | 21.5 | 21.3 | 21.7 | 21.3 | 21.2 |
| Example 4 | 19.9 | 19.3 | 19.0 | 19.2 | 19.6 | 19.5 |
| Comparative Example 1 | 23.5 | 24.2 | 24.5 | 25.2 | 25.7 | 26.7 |
| Comparative Example 2 | 23.7 | 25.2 | 27.3 | 20.4 | 19.6 | 18.0 |
| Comparative Example 3 | 22.3 | 20.2 | 21.8 | 23.1 | 19.8 | 19.3 |
| Comparative Example 4 | 19.8 | 20.1 | 19.2 | 18.3 | 18.5 | 16.9 |
| Comparative Example 5 | 18.7 | 19.4 | 19.0 | 19.1 | 17.2 | 16.3 |

TABLE 3B

| | Toner Electric Charge (−μC/g) | | | | | |
|---|---|---|---|---|---|---|
| | 1st piece | 10000th piece | 20000th piece | 30000th piece | 40000th piece | 50000th piece |
| Example 5 | 21.6 | 21.3 | 21.4 | 21.7 | 21.6 | 21.7 |
| Example 6 | 22.1 | 21.4 | 21.8 | 21.7 | 21.6 | 21.7 |
| Example 7 | 19.9 | 20.3 | 20.2 | 19.9 | 20.1 | 20.1 |
| Example 8 | 20.2 | 20.1 | 20.1 | 19.9 | 19.8 | 19.9 |
| Comparative Example 6 | 20.2 | 20.1 | 20.1 | 19.9 | 19.8 | 19.9 |
| Comparative Example 7 | 21.2 | 21.4 | 22.9 | 24.5 | 27.1 | 27.5 |
| Comparative Example 8 | 20.1 | 20.4 | 18.5 | 18.2 | 16.5 | 16.4 |
| Comparative Example 9 | 19.2 | 19.2 | 18.1 | 17.2 | 17.1 | 16.2 |

TABLE 3C

| | Toner Electric Charge (−μC/g) | | | | | |
|---|---|---|---|---|---|---|
| | 1st piece | 10000th piece | 20000th piece | 30000th piece | 40000th piece | 50000th piece |
| Example 9 | 21.3 | 21.4 | 21.4 | 21.3 | 21.4 | 21.4 |
| Example 10 | 20.8 | 20.3 | 20.5 | 20.5 | 20.6 | 20.4 |
| Comparative Example 10 | 20.4 | 20.5 | 20.1 | 20.1 | 18.2 | 18.4 |

From the results of Tables above-mentioned, the following was found in the developers of the type in which the carrier coating resin contained dodecyl methacrylate. With the developer of Comparative Example 1 in which the $C_A/T_A$ exceeded 6, the image density was lowered and the amount of toner electric charge was not constant but increased substantially unilaterally throughout the continuous copying operation. The developer of Comparative Example 5 in which the $C_A/T_A$ was less than 3, not only produced toner scattering, fog and decrease in resolution due to decrease in electric charge properties, but also showed variations in the amount of toner electric charge throughout the continuous copying operation. The developer of Comparative Example 2 which used the toner presenting $T_A$ of less than 10% by weight and in which the $C_A/T_A$ exceeded 6, there were observed not only considerable decrease in image density but also considerable variations in the amount of toner electric charge throughout the continuous copying operation. Further, the amount of electric charge was lowered on and after around the 40,000th copied piece in the continuous copying operation, resulting in toner scattering, fog and decrease in resolution. With the developer of Comparative Example 4 jointly using the toner in which the $T_A$ was less than 10% by weight and the carrier in which the $C_A$ exceeded 90% by weight so that the $C_A/T_A$ exceeded 6, the amount of toner electric charge was decreased substantially unilaterally throughout the continuous copying operation, thereby to produce toner scattering, fog and decrease in resolution. With the developer of Comparative Example 3 containing no dodecyl methacrylate and using the carrier in which the $C_A$ was less than 70% by weight, the amount of toner electric charge was changed throughout the continuous copying operation and all the characteristics above-mentioned were insufficient. On the other hand, each of Examples 1 to 4 of the present invention was excellent in all the characteristics above-mentioned and always showed the constant amount of electric charge throughout the 50,000-piece continuous copying operation. Each of the carriers of the developers of the type in which the carrier coating resin contained dodecyl methacrylate, was observed as magnified 1000 times, with an electron microscope, before and after subjected to the 50,000-piece continuous copying operation. It was found that each of the carriers of Comparative Examples 3, 4 showed remarkable deterioration in that the coating resin came off and falled down, but each of the carriers of Examples 1 to 4 of the present invention showed substantially no deterioration even after the 50,000-piece copying operation.

The following was found in the developers of the type in which the carrier coating resin contained 2-hydroxyethyl acrylate. The developer of Comparative Example 6 in which the $C_A/T_A$ exceeded 6, showed decrease in image density. With the developer of Comparative Example 9 in which the $C_A/T_A$ was less than 3, there were observed not only toner scattering, fog and decrease in resolution due to decrease in electric charge properties, but also substantially unilateral decrease in the amount of toner electric charge throughout the continuous copying operation. With the developer of Comparative Example 7 using the toner in which the $T_A$ was less than 10% by weight and presenting $C_A/T_A$ which exceeded 6, there were observed not only considerable decrease in image density but also considerable increase in the amount of toner electric charge throughout the continuous copying operation. Also, the resolution was lowered. With the developer of Comparative Example 8 using the carrier in which the $C_A$ was less than 70% by weight, the decrease in the amount of toner electric charge throughout the continuous copying operation was remarkable, thereby to produce toner scattering, fog and decrease in resolution. On the other hand, each of the developers of Examples 5 to 8 of the present invention was excellent in all the characteristics above-mentioned and always showed the constant amount of electric charge throughout the 50,000-piece continuous copying operation.

The following was found in the developers of the type in which the carrier coating resin contained dodecyl methacrylate and 2-hydroxyethyl acrylate. With the developer of Comparative Example 10 using the toner in which the $T_A$ was less than 10% by weight and presenting $C_A/T_A$ which exceeded 6, the amount of toner electric charge was decreased substantially unilaterally throughout the continuous copying operation, thereby to produce fog and toner scattering. On the other hand, each of the developers of Examples 9, 10 of the present invention was excellent in all the characteristics abovementioned and always showed the constant amount of electric charge throughout the 50,000-piece continuous copying operation.

EXAMPLES 11 TO 13 AND COMPARATIVE EXAMPLE 11 to 15

The following toners and carriers were combined with each other in the manners shown in Table 5 at a ratio by weight of 3.5:96.5, and agitated and mixed with a Nauter mixer (NX-S manufactured by Hosokawa Micron Co., Ltd.) to produce developers of Examples 11 to 13 and Comparative Examples 11 to 15.

Toner (e)

There were mixed (i) 100 parts by weight of a styrene (St)/methyl methacrylate (MMA)/butyl acrylate (BA) copolymer [St:MMA:BA 80:5:15 (ratio by weight)], (ii) 10 parts by weight of carbon black as the coloring agent, (iii) 2 parts by weight of a metal-containing monoazo dye as the electric charge controlling dye, and (iv) 3 parts by weight of low molecular-weight polypropylene as the off-set preventing agent. After molten and kneaded, the resulting mixture was cooled, ground and classified to produce a toner (e) having the average particle size of 10.1 μm and presenting 0.52% as the percentage by the number of toner particles of which sizes as measured with a coalter counter exceeded 16 μm. The toner (e) presented a surface dye density of 0.0052 g/g as calculated based on the data obtained by measuring, according to an absorbance measuring method, a solution extracted from the toner (e) with methyl alcohol.

Toners (f) to (i)

With the use of the same materials as those for the toner (e), there were prepared toners (f) to (i) respectively having the characteristics shown in Table 4, with the content of the metal-containing monoazo dye, the preliminary material mixing time, the kneading speed and the kneading temperature being suitably changed for the respective toners (f) to (i).

TABLE 4

| | Surface dye density (g/g) | Average particle size (μm) | Particles having sizes of not less than 16 μm (% by the number of particles) |
|---|---|---|---|
| Toner (e) | 0.0052 | 10.1 | 0.52 |
| Toner (f) | 0.0058 | 11.1 | 0.49 |
| Toner (g) | 0.0042 | 10.5 | 0.53 |
| Toner (h) | 0.0063 | 10.3 | 0.42 |
| Toner (i) | 0.0036 | 10.5 | 0.63 |

Carrier (14)

By a fluidized bed method, ferrite as the carrier core material was coated at the surface thereof with a solution containing (i) 100 parts by weight of a styrene (St)/ethyl methacrylate (EMA)/dodecyl methacrylate (DMA) copolymer [St:EMA:DMA=20:78:2 (ratio by weight)] as the coating resin and (ii) 2 parts by weight of carbon black as the resistance adjusting agent, thereby to prepare a carrier (14) having the average particle size of 100μm of which coating layer had a thickness of 2 μm.

Carrier (15)

There was prepared a carrier (15) in the same manner as in the carrier (14) except for the use of 100 parts by weight of a styrene (St)/ethyl methacrylate (EMA)/-dodecyl methacrylate (DMA) copolymer [St:EMA:DMA 25:73:2 (ratio by weight)] instead of 100 parts by weight of the coating resin used in the carrier (14).

Carrier (16)

There was prepared a carrier (16) in the same manner as in the carrier (14) except for the use of 100 parts by weight of a styrene (St)/ethyl methacrylate (EMA)/-dodecyl methacrylate (DMA) copolymer [St:EMA:DMA 15:80:5 (ratio by weight)] instead of 100 parts by weight of the coating resin used in the carrier (14).

Carrier (17)

There was prepared a carrier (17) in the same manner as in the carrier (14) except for the use of 100 parts by weight of a styrene (St)/ethyl methacrylate (EMA) copolymer [St:EMA=25:75 (ratio by weight)] instead of 100 parts by weight of the coating resin used in the carrier (14).

Carrier (18)

There was prepared a carrier (18) in the same manner as in the carrier (14) except for the use of 100 parts by weight of a styrene (St)/ethyl methacrylate (EMA) copolymer [St:EMA=5:95 (ratio by weight)] instead of 100 parts by weight of the coating resin used in the carrier (14).

Carrier (19)

There was prepared a carrier (19) in the same manner as in the carrier (14) except for the use of 100 parts by weight of a styrene (St)/ethyl methacrylate (EMA) copolymer [St:EMA=35:65 (ratio by weight)] instead of 100 parts by weight of the coating resin used in the carrier (14).

TABLE 5

| | Toner | Carrier |
|---|---|---|
| Example 11 | (e) | (14) |
| Example 12 | (f) | (15) |
| Example 13 | (g) | (16) |
| Comparative Example 11 | (e) | (17) |
| Comparative Example 12 | (h) | (14) |
| Comparative Example 13 | (i) | (14) |
| Comparative Example 14 | (g) | (18) |
| Comparative | (h) | (19) |

TABLE 5-continued

| | Toner | Carrier |
|---|---|---|
| Example 15 | | |

The tests above-mentioned were conducted on each of the electrophotographic developers of Examples 11 to 13 and Comparative Examples 11 to 15. The results are shown in Table 6A and 6B.

TABLE 6A

| | Image Density | Image Fog | Resolution | Toner Scattering |
|---|---|---|---|---|
| Example 11 | ○ | ○ | ○ | ○ |
| Example 12 | ○ | ○ | ○ | ○ |
| Example 13 | ○ | ○ | ○ | ○ |
| Comparative Example 11 | ○ | Δ | Δ | ○ |
| Comparative Example 12 | ○ | Δ | Δ | Δ |
| Comparative Example 13 | Δ | Δ | ○ | ○ |
| Comparative Example 14 | Δ | Δ | Δ | Δ |
| Comparative Example 15 | Δ | X | X | X |

TABLE 6B

| | Toner Electric Charge (−μC/g) | | | | | |
|---|---|---|---|---|---|---|
| | 1st piece | 10000th piece | 20000th piece | 30000th piece | 40000th piece | 50000th piece |
| Example 11 | 21.3 | 21.5 | 21.2 | 21.2 | 21.1 | 21.3 |
| Example 12 | 20.2 | 20.4 | 20.1 | 20.2 | 20.3 | 20.1 |
| Example 13 | 22.4 | 22.2 | 22.1 | 22.2 | 22.3 | 22.1 |
| Comparative Example 11 | 21.3 | 21.2 | 20.1 | 19.2 | 19.0 | 18.9 |
| Comparative Example 12 | 21.4 | 21.3 | 21.0 | 19.2 | 18.5 | 18.1 |
| Comparative Example 13 | 21.6 | 22.4 | 23.1 | 23.4 | 24.7 | 25.2 |
| Comparative Example 14 | 21.3 | 23.2 | 23.6 | 21.2 | 19.7 | 18.6 |
| Comparative Example 15 | 20.5 | 20.9 | 18.7 | 17.3 | 16.2 | 15.6 |

From the results of Tables 6A and 6B, the following was found. With each of the developers of Comparative Examples 11, 14 using the carrier in which the coating resin did not contain dodecyl methacrylate and Comparative Example 12 in which the surface dye density exceeded 0.006 g/g, the amount of toner electric charge was substantially unilaterally decreased throughout the continuous copying operation, thereby to produce fog, toner scattering and decrease in resolution. With the developer of Comparative Example 13 using the toner of which surface dye density was less than 0.004 g/g, the image density was decreased and the amount of toner electric charge was substantially unilaterally increased throughout the continuous copying operation. With the developer of Comparative Example 15 jointly using the toner of which surface dye density exceeded 0.006 g/g and the carrier in which the coating resin did not contain dodecyl methacrylate, the decrease in the amount of toner electric charge at the time of continuous copying was remarkable, thereby to produce fog, a great amount of toner scattering and decrease in resolution. On the other hand, each of the developers of Examples 11 to 13 of the present invention was excellent in all the characteristics above-mentioned and always showed the constant amount of electric charge throughout the 50,000-piece continuous copying operation.

We claim:

1. An electrophotographic developer which comprises (i) a toner containing, as a fixing resin, a styrene-acrylic copolymer including an acrylic component in a range from 10 to 30% by weight ($T_A$) and (ii) a carrier coated with a coating resin composed of a styrene-acrylic copolymer containing at least dodecyl methacrylate and including an acrylic component in a range from 70 to 90% by weight ($C_A$) and wherein said dodecyl methacrylate is present in the acrylic component of said styrene-acrylic copolymer in a range from 0.1 to 5% by weight; and in which the ratio of said $C_A$ and $T_A$ values $C_A/T_A$ is in a range from greater than 3 to smaller than 6.

2. An electrophotographic developer according to claim 1, wherein the coating resin contains ethylmethacrylate.

3. An electrophotographic developer according to claim 1, wherein the coating resin contains 2-hydroxyethyl acrylate.

4. An electrophotographic developer which comprises (i) a toner containing, as a fixing resin, a styrene-acrylic copolymer including an acrylic component in a range from 10 to 30% by weight ($T_A$) and (ii) a carrier coated with a coating resin composed of a styrene-acrylic copolymer containing at least 2-hydroxyethyl acrylate and including an acrylic component in a range from 70 to 90% by weight ($C_A$) and wherein said 2-hydroxyethyl acrylate is present in the acrylic component of said styrene-acrylic copolymer in a range from 0.1 to 5% by weight, and in which the ratio of said $C_A$ and $T_A$ values $C_A/T_A$ is in a range from greater than 3 to smaller than 6.

5. An electrophotographic developer according to claim 4, wherein the coating resin contains ethylmethacrylate.

6. An electrophotographic developer comprising (i) a toner in which a fixing resin contains a coloring agent and an electric charge controlling dye and of which surface dye density is in a range from 0.004 to 0.006 g/g and (ii) a carrier coated with a coating resin in which a resistance adjusting agent is contained in a styrene-acrylic copolymer containing at least dodecyl methacrylate and including an acrylic component in a range from 70 to 90% by weight and wherein said dodecyl methacrylate is present in the acrylic component of said styrene-acrylic copolymer in a range from 0.1 to 5% by weight.

7. An electrophotographic developer according to claim 6, wherein the electric charge controlling dye is a metal-containing monoazo dye.

8. An electrophotographic developer according to claim 6, wherein the percentage by the number of toner particles of which sizes as measured with a coalter counter exceed 16 μm, is in a range satisfying the following formula (III):

$$N < -172.7^{\circ}\ C. + 1.45 \qquad \text{(III)}$$

wherein N is the percentage by the number of toner particles of which sizes as measured with a coalter counter exceed 16 μm, and C is surface dye density (g/g) of said toner particles.

9. An electrophotographic developer according to claim 6, in which the ratio of content of the resistance adjusting agent in the coating resin is in a range from 0.5 to 5% by weight.

10. An electrophotographic developer according to claim 6, wherein the resistance adjusting agent is a carbon black.

* * * * *